United States Patent [19]

Ishida

[11] Patent Number: 4,707,145

[45] Date of Patent: Nov. 17, 1987

[54] ELECTRONIC TIMEPIECE

[75] Inventor: Takashi Ishida, Tokyo, Japan

[73] Assignee: Kabushiki Kaisha Daini Seikosha, Tokyo, Japan

[21] Appl. No.: 968,689

[22] Filed: Dec. 15, 1978

[30] Foreign Application Priority Data

Dec. 12, 1977 [JP] Japan ..... 52-149485

[51] Int. Cl.[4] ..... G04B 17/12

[52] U.S. Cl. ..... 368/201

[58] Field of Search ..... 368/85-87, 368/155-157, 217-219, 200-202

[56] References Cited

U.S. PATENT DOCUMENTS

| | | | |
|---|---|---|---|
| 3,945,194 | 3/1976 | Gollinger | 368/156 |
| 4,004,407 | 1/1977 | Fujita | 368/201 |
| 4,020,626 | 5/1977 | Kuwabara et al. | 368/201 |
| 4,055,945 | 11/1977 | Schwarzschild | 368/201 |
| 4,101,838 | 7/1978 | Alhara et al. | 368/201 X |
| 4,142,360 | 3/1979 | Akahane | 368/201 X |
| 4,155,218 | 5/1979 | Wiget | 368/69 |

*Primary Examiner*—Vit W. Miska

*Attorney, Agent, or Firm*—Bruce L. Adams; Van C. Wilks

[57] ABSTRACT

An electronic timepiece has an oscillator for generating a high frequency time standard signal which is frequency-divided by a multi-stage divider circuit. A memory stores time adjustment information for use in adjusting the time in the event the oscillator time standard signal is higher than a predetermined frequency. The memory is connected to a preset circuit for presetting the divider circuit in accordance with the content of the memory. The divider circuit comprises 16 dividing stages and when no time adjustment is needed, the divider output is taken from the 15th stage in the conventional manner whereas when time adjustment is being carried out, the divider output is taken from the 16th stage. A selecting circuit applies either the output form the 15th or 16th stage to a display device depending on whether or not time adjustment information is stored in the memory.

4 Claims, 3 Drawing Figures

ELECTRONIC TIMEPIECE

BACKGROUND OF THE INVENTION

This invention relates to an electronic timepiece having a variable divider.

In a conventional electronic timepiece, for taking out an accurate output frequency from a divider circuit, the oscillating frequency of the time standard oscillator itself is changed by changing the circuit constant of the oscillator. For example, this is carried out using a trimmer condenser which is a kind of variable capacitor. However, since the mechanical parts of a trimmer condenser lack in reliability the circuit constant of the oscillator is not able to maintain a constant value.

In a conventional electronic timepiece having a variable divider, there is no direct relationship between the output frequency of the divider and the standard oscillating frequency of the oscillator so that the oscillating frequency cannot necessarily be determined from the divider output.

SUMMARY OF THE INVENTION

Therefore an object of this invention is to provide an electronic timepiece having a variable divider the variable function of which is prohibitted by predetermined information from a memory means to permit determination of the oscillating frequency of the time standard oscillator from the output frequency of the divider.

Another object of this invention is to provide an electronic timepiece having a variable divider the dividing ratio of which is changed by the position of switches in a memory means.

A further object of the invention is to eliminate the trimmer condenser conventionally used in an electronic timepiece.

A still further object of the invention is to simplify the circuit design of an electronic timepiece.

The foregoing objects and other objects as well as the characteristic features of the invention will become more apparent and more readily understandable by the following description and the appended claims when read in conjunction with the accompanying drawings.

DETAILED DESCRIPTION OF THE INVENTION

Figure 1:
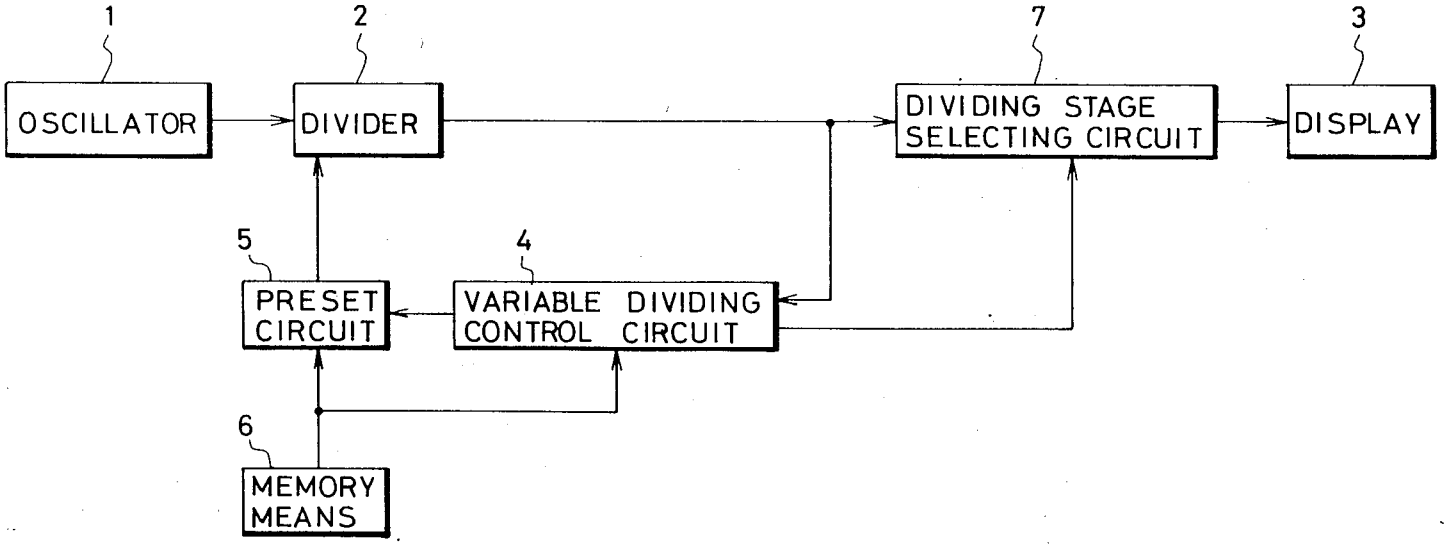
FIG. 1 is a block diagram of an electronic timepiece according to the invention.

Now referring to FIG. 1, the circuit according to the invention consists of a divider 2 which divides output signals from a time standard oscillator 1, a preset circuit 5 for presetting predetermined stages of the divider 2, a memory means 6 for memorizing informations to preset the divider stages, a variable dividing control circuit 4 which controls the presetting action by the output from the divider 2, a dividing stage selecting circuit 7 which selects divider stages by the output from the variable dividing control circuit 4, and a display device 3 which displays information according to the output signals from the dividing stage selecting circuit 7.

As known in the art, an ordinal liquid crystal display device having segments in the shape of the numeral eight can be used as the display device in this case.

Figure 2:
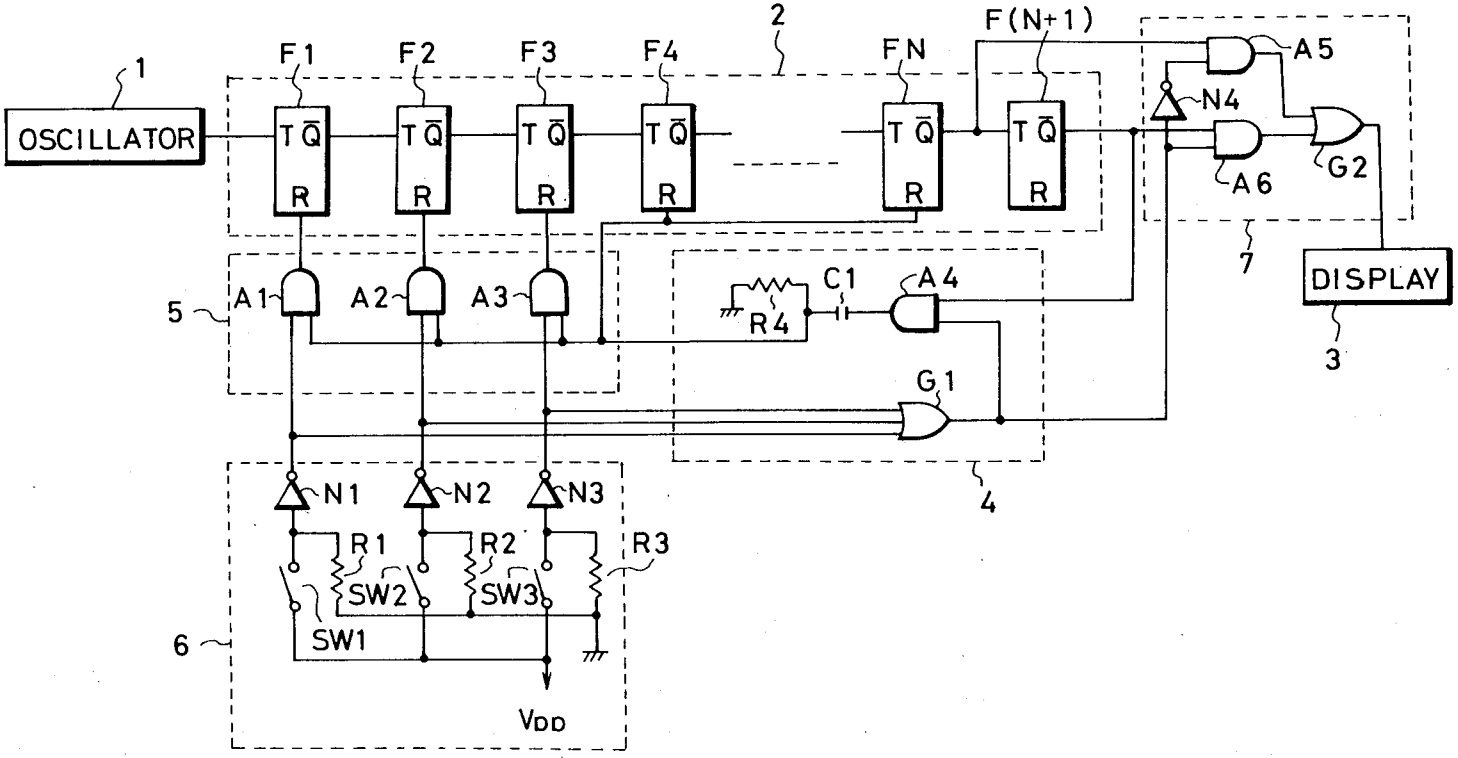
FIG. 2 is a circuit diagram of the embodiment shown in FIG. 1.

FIG. 2 shows one embodiment of the circuit according to this invention. The memory means 6 consists of three switches SW1, SW2 and SW3, three resistors R1, R2 and R3, and three inverters N1, N2 and N3. One end of each switch SW1–3 is connected to a power source $V_{DD}$ and the other ends are connected to respective inverters N1, N2 and N3, and connected at the same time to ground via respective resistors R1, R2 and R3. The preset circuit 5 has three AND gates A1, A2 and A3, one input terminal of these AND gates is connected to each inverter N1, N2 and N3 respectively, and the other input terminals of these AND gates are connected in common.

The divider 2 consists of series-connected flip-flop circuits F1–FN and an additional flip-flop circuit F(N+1) which is not incorporated into the ordinary divider circuit. The time standard oscillator 1 is connected to the first divider stage F1 and outputs of each AND gate A1–3 are connected to the reset terminal R of flip-flops F1–3 respectively. The reset terminal R of the other flip-flops F4–FN are connected in common and connected to the common input terminals of AND gates A1–3.

The variable dividing control circuit 4 consists of OR gate G1, AND gate A4 and a differentiation circuit having a condenser C1 and a resistor R4. Input terminals of the OR gate G1 are connected to the output of each inverter N1–3 respectively, and the output terminal of the OR gate G1 is connected to an input terminal of AND gate A4 and is connected to an input of AND gate A6 and inverter N4 of the dividing stage selecting circuit. The condenser C1 and the resistor R4 are connected in series and connected between the output of AND gate A4 and ground. The common input terminal of AND gates A1–3 is connected between the resistor R4 and the condenser C1. The other input of AND gate A4 is connected to the $\overline{Q}$ output of the additional flip-flop F(N+1) of the divider 2.

The dividing stage selecting circuit 7 consists of inverter N4, and gates A5 and A6, and OR gate G2. One input of AND gate 5 is connected to the output of OR gate G1 via inverter N4 and the other input is connected to the $\overline{Q}$ output of the flip-flop FN of the divider 2. While the other input of AND gate A6 is connected to the $\overline{Q}$ output of the additional flip-flop F(N+1) of the divider 2. Both outputs of AND gates A5 and A6 are connected to the input of OR gate G2, and the output of OR gate G2 is connected to the display divice 3.

Figure 3:
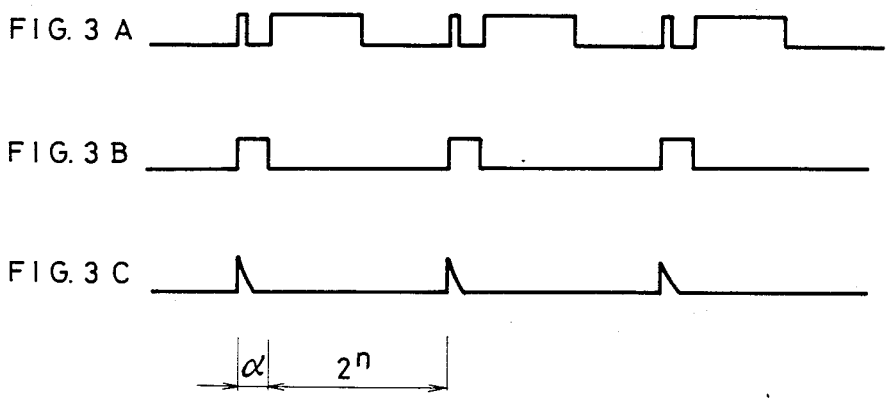
FIG. 3 shows time charts explaining the action of the circuit, FIG. 3*a* showing the output waveform of the flip-flop of the N stage, FIG. 3*b* showing the output waveform of the flip-flop of the (N+1) stage and FIG. 3*c* showing the differentiated output waveform of AND gate A4.

The construction of the circuit is such that the function of the circuit is explained referring FIG. 3. The output frequency of the divider 2 is 1 HZ and the oscillating frequency of the time standard oscillator 1 is 32,768 ($=2^{15}$) HZ. Since the divider 2 has one more stage as compared to the conventional divider circuit, it has 16 stages.

When the $\overline{Q}$ output of the divider 2 (16th stage) changes from LOW to HIGH (refer to FIG. 3B), AND gate A4 produces an output signal which is differentiated by the condenser C1 and the resistor R4 as shown in FIG. 3C. When at least one switch selected from the group SW1–3 of the memory means 6 is in the OFF state, then the output of OR gate G1 is in the HIGH state. The differentiated pulse width should have sufficient width to reset flip-flops F1–F3 and should be narrower than that of the output pulse of the time standard oscillator 1.

When this differentiated pulse is applied to AND gates A1–3, the flip-flops F1–3 are preset in the case a HIGH level signal is applied to at least one of the other inputs of AND gates A1–3. In other words, the content preset at this time for effecting time adjustment is the content expressed by switches SW1–3, and is higher by the amount ($\alpha$) as compared to the time standard oscillating frequency ($2^n$) as shown in FIG. 3C. If, for example, the time standard oscillating frequency of the oscillator is 32, 772 HZ, the binary code corresponding to the decimal code "three" is preset at this time (switch SW3 is OFF, switches SW1 and SW2 are ON).

Since one pulse is necessary for presetting the divider 2, the divider 2 repeats its counting action after counting "four" pulses more than 32, 768 pulses (refer to FIG. 3A). As mentioned above, the dividing ratio of the variable divider 2 can be changed by simply changing the state of switches SW1–3 in the memory means 6.

According to the invention, it is possible to know the oscillating frequency directly. When all the switches SW1–3 in the memory means 6 switch to the ON state, the output of the OR gate G1 in the variable dividing control circuit 4 switches to the LOW state. Since the output of the flip-flop F(N+1) is cut off, the divider 2 is switched to act as a conventional 15-stage divider by the action of the dividing stage selecting circuit 7. Since the divider 2 acts as an ordinary fixed ratio divider, the oscillating frequency can be easily calculated by counting the output frequency of the divider 2.

Although the invention has been shown in connection with a certain specific embodiment, it will be readily apparent to those skilled in the art that various changes in circuit construction may be made to suit particular requirements without departing from the spirit and scope of the invention.

I claim:

1. An electronic timepiece comprising: an oscillator for generating a time standard signal; a variable divider for dividing the time standard signal, said variable divider comprising a predetermined number of dividing stages for dividing the oscillator time standard signal, and one additional dividing stage connected to the last one of said predetermined number of dividing stages for use when the oscillator time standard signal is higher than a predetermined standard frequency; a preset circuit connected to said variable divider for presetting the dividing stages; a display device for displaying time information; memory means for storing signals corresponding to a preselected time adjustment to be made when the oscillator time standard signal is higher than said predetermined standard frequency and for applying such signals to said preset circuit; selecting means for selecting one of the outputs of the dividing stages of said variable divider and applying the selected output to said display device in accordance with the output of said memory means; and means for controlling operation of said preset circuit in accordance with the output of said one additional dividing stage.

2. In an electronic timepiece having an oscillator for generating a high frequency time signal suitable as a time standard: resettable dividing means connected to said oscillator and comprised of multi-stages for frequency-dividing the time signal in successive stages; display means connected to receive the frequency-divided output signals from at least the last two stages of said dividing means for displaying time information corresponding to one of the respective output signals; presetting means for presetting said dividing means; means including a settable memory for memorizing preselected time adjustment information for making a time adjustment when the high frequency time signal generated by said oscillator is higher than a predetermined frequency and coacting with said presetting means to preset said dividing means in accordance with the memorized time adjustment information; and selecting means for selecting the time signals to be applied to said display means to enable the frequency-divided time signal from the last stage of said dividing means to be applied to said display means when the oscillator high frequency time signal is higher than said predetermined frequency and to otherwise enable the frequency-divided time signal from the next-to-last stage of said dividing means to be applied to said display means.

3. An electronic timepiece according to claim 2; wherein said settable memory includes a plurality of switches each having two switching states to enable time adjustment information to be input in binary form.

4. An electronic timepiece according to claim 2; wherein said dividing means comprises 16 dividing stages connected together in cascade.

* * * * *